US010549961B2

(12) United States Patent
Roodenburg et al.

(10) Patent No.: US 10,549,961 B2
(45) **Date of Patent: *Feb. 4, 2020**

(54) MARINE KNUCKLE BOOM CRANE

(71) Applicant: ITREC B.V., Schiedam (NL)

(72) Inventors: Joop Roodenburg, Delft (NL); Hendrikus Jacobus Weterings, 's-Gravenzande (NL)

(73) Assignee: ITREC B.V., Schiedam (NL)

( * ) Notice: Subject to any disclaimer, the term of this patent is extended or adjusted under 35 U.S.C. 154(b) by 231 days.

This patent is subject to a terminal disclaimer.

(21) Appl. No.: 15/783,673

(22) Filed: Oct. 13, 2017

(65) Prior Publication Data

US 2018/0037445 A1 Feb. 8, 2018

Related U.S. Application Data

(63) Continuation of application No. 14/409,329, filed as application No. PCT/NL2013/050511 on Jul. 8, 2013, now Pat. No. 9,809,429.

(30) Foreign Application Priority Data

Jul. 16, 2012 (NL) ..... 1039734
Nov. 16, 2012 (NL) ..... 2009821

(51) Int. Cl.
*B66C 23/52* (2006.01)
*B63B 27/10* (2006.01)
(Continued)

(52) U.S. Cl.
CPC ..... *B66C 23/52* (2013.01); *B63B 27/10* (2013.01); *B66C 23/56* (2013.01); *B66C 23/64* (2013.01); *B66C 23/66* (2013.01)

(58) Field of Classification Search
CPC ..... B66C 23/52; B66C 23/56; B66C 23/64; B66C 23/66; B63B 27/10; B63B 27/36; B63B 23/04
See application file for complete search history.

(56) References Cited

U.S. PATENT DOCUMENTS 1,920,370 A 8/1933 Forsythe et al.
3,464,570 A 9/1969 Mork
(Continued)

FOREIGN PATENT DOCUMENTS

EP 2 194 017 A1 6/2010
FR 2 469 375 A1 5/1981

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A marine knuckle boom crane includes a crane housing which is rotational relative to a pedestal about a vertical rotation axis and a knuckle boom assembly attached to the crane housing. The knuckle boom assembly includes a main boom, the inner end of which is connected pivotably about a first horizontal pivot axis to the crane housing; and a jib, the inner end of which is connected pivotably about a second horizontal pivot axis to the outer end of the main boom, wherein the jib is pivotable at least between an extended position in which the tip extends mainly forward from the main boom, and a folded position in which the jib is folded back, essentially parallel along the main boom. In order to position the jib with respect to the main boom, a tensioning member is provided extending between the crane housing and a curved extension guide connected to the jib.

12 Claims, 7 Drawing Sheets

(51) Int. Cl.

| | |
|---|---|
| ***B66C 23/64*** | (2006.01) |
| ***B66C 23/66*** | (2006.01) |
| ***B66C 23/00*** | (2006.01) |

(56) References Cited

U.S. PATENT DOCUMENTS

| | | | | |
|---|---|---|---|---|
| 3,685,668 | A | 8/1972 | Suverkrop | |
| 4,363,410 | A | 12/1982 | Sprengel | |
| 4,383,616 | A | 5/1983 | Sterner et al. | |
| 4,473,214 | A * | 9/1984 | Sterner | B66C 23/82 248/654 |

* cited by examiner

MARINE KNUCKLE BOOM CRANE

CROSS-REFERENCE TO RELATED APPLICATIONS

This application is a Continuation of U.S. patent application Ser. No. 14/409,329 filed on Dec. 18, 2014, which was filed as the National Phase of International Application No. PCT/NL2013/050511 filed on Jul. 8, 2013, which claims priority to Dutch Application Nos. 2009821 filed on Nov. 16, 2012 and U.S. Pat. No. 1,039,734 filed on Jul. 16, 2012, all of which are hereby expressly incorporated by reference into the present application.

The present invention relates to a marine knuckle boom crane comprising:

- a stationary pedestal to be mounted to or formed integral with a vessel; and
- a crane housing having an upper portion, a central portion and a lower portion, which is rotational relative to the pedestal about a vertical rotation axis;
- a knuckle boom assembly attached to the crane housing; the knuckle boom assembly comprising:
  - a main boom comprising an inner end, a central area and an outer end, the inner end of which is connected pivotably about a first horizontal pivot axis to a lower portion of the crane housing; and
  - a jib comprising an inner end, a central area and a tip opposite the inner end of the jib, the inner end of which is connected pivotably about a second horizontal pivot axis to the outer end of the main boom;
  - wherein the jib is pivotable at least between an extended position in which the tip extends mainly forward from the main boom, and a folded position in which the jib is folded back, essentially parallel along the main boom.

A conventional crane is provided with a hoist winch and a hoisting cable, extending from the hoist winch via sheaves over a departing sheave of a boom to a load suspension device, which crane can be used both to lift and lower materials and to move them horizontally. It is mainly used for lifting heavy things and transporting them to other places. The load suspension device preferably comprises a crane hook or the like to connect the load.

In a knuckle boom crane the boom comprises at least two parts: a main boom and a jib. The boom articulates at the 'knuckle' near the middle, letting it fold back like a finger, thus creating the so-called knuckle boom. This provides a compact size for storage and maneuvering.

The knuckle boom crane has been particular advantageous for marine purposes as the 'folded back finger' of the crane allows the crane to hoist loads with the tip of the jib close to the vessel, in particular to the deck of the vessel. This way, movements of the load can be limited as the tip of the jib can be kept at a limited height above deck. Also, as the force of the load is introduced at a lower point of the crane, the stability of the vessel is increased. These features makes the crane safe and efficient.

To operate the knuckle boom, both parts of the boom, the main boom and the jib, are individually controlled. Conventionally hydraulic cylinders are used, which are suitable for small knuckle boom cranes capable of hoisting loads from a few thousand kilos up to loads up to 50 tons. Upon further upscaling the knuckle boom crane to be able to hoist even larger loads, up to a few hundred tons, it has been found that the use of hydraulic cylinders may cause limitations in reach of the crane and the maximum load.

The aim of the present invention is to provide an alternative control mechanism for the main boom and the jib of a marine knuckle boom crane.

This is achieved according to the present invention such that in order to position the jib with respect to the main boom, a tensioning member and a curved extension guide are provided, the tensioning member extending between the crane housing and the curved extension guide, and the curved extension guide being connected to the jib and being pivotable together with the jib about the second pivot axis, and guiding a portion of the tensioning member, wherein a tensioning winch allows to vary the length of the tensioning member and thus to position the jib; in order to position the main boom, a luffing cable is provided, extending between the outer end of the main boom and the upper portion of the crane housing, and wherein a luffing winch allows to vary the length of the luffing cable and thus to position the main boom.

The combination of a tensioning member and a curved extension guide enables an accurate control of the position of the jib at a range of different positions with respect to the main boom: from an extended position in which the tip extends mainly forward from the main boom, to a folded position in which the jib is folded back, essentially parallel along the main boom. The tensioning member is guided by the curved extension guide. In a possible embodiment, the curved extension guide is provided with a groove in which a cable of the tensioning member is guided. Any type of groove and cable combination can be used, for example, the cable can be embodied as a chain.

The provision of a tensioning member and a curved extension guide according to the invention allows a vast range of positions of the jib, using simple means such as cables and a tensioning winch. Consequently, the design options for the dimensions of the main boom and the jib are no longer limited by the restrictions inherent to the use of a cylinder between them: smaller cross-sections of the main boom and jib are possible, and a wider variety of mutual dimensions.

The tensioning member may comprise a cable portion, a chain portion, or interconnected elongated rods. In a possible embodiment the tensioning member comprises multiple articulated interconnected elongated rods, wherein the pivot points between the elongated rods are adapted to connect to the distal ends of the 'spokes' of the extension guide. An advantage of such an embodiment is that slip of the elongated tensioning member over the extension guide is not possible.

It is noted that the use of a luffing device to position the main boom is known from, and similar to conventional cranes having a single boom. The main boom comprises an outer end and an opposite inner end which is connected pivotably about a first horizontal pivot axis to the crane housing, allowing an up-and-down movement of the main boom. The luffing device possibly comprises a luffing cable and a luffing winch. Varying the length of the luffing cable allows a pivoting movement of 90-180° of the main boom, such that the main boom can move between an essentially vertical upright position and a lowered position in which the main boom extends at an angle of 90-180° (thus perpendicular to the upright or extending downwards) with respect to the vertical position.

In a possible embodiment, the curved extension guide is provided with a groove in which a portion of the tensioning member is guided. Any type of groove and cable combination can be used, for example, the cable portion can be embodied as a chain. Alternatively, the extension guide may be provided with protrusions which may cooperate with indentations in the elongated tensioning member, e.g. within a link.

In an embodiment, the extension guide defines a curvature to guide the tensioning member, preferably approximating a portion of a circle or oval, preferably having the second pivot axis as a center.

Possibly, the curve of the extension guide is approximated by a polygon, e.g. formed by multiple interconnected straight surfaces. The tensioning member can in that case for example comprise multiple interconnected links of essentially the same length as the cooperating straight surfaces. The polygon can be formed by the distal outer ends of two or more 'spokes', preferably extending from a common central axis, preferably the second pivot axis. The spokes may be interconnected at their distal outer ends, but embodiments without such an interconnection are also conceivable. According to the invention, the tensioning member extends between the crane housing and the curved extension guide. In an embodiment, the tensioning member comprises multiple articulated interconnected elongated rods. In a possible embodiment, the pivot points between the elongated rods are adapted to connect to the distal ends of the 'spokes' of the curved extension guide. An advantage of such an embodiment is that slip of the tensioning member over the curved extension guide is not possible.

In a possible embodiment, the tensioning member comprises a set of cables and sheaves, which cables are allowed to be hauled in and paid out by the tensioning winch to vary the length of the tensioning member. For example, a sheave is attached to a cable of the tensioning member which is guided in the curved extension guide. Alternatively, it is also conceivable that a cylinder is used as a tensioning winch, attached to a cable of the tensioning member which is guided in the curved extension guide and to the crane housing. It should be noted that a large stroke of the cylinder is required to be able to achieve all positions of the jib, which stroke may be impossible in some configurations of the knuckle boom crane.

According to the invention, the tensioning member extends between the curved extension guide and the crane housing. It is conceivable that the tensioning member is connected to an upper end of the curved extension member, however, it is also possible that the tensioning member is connected to the jib.

The marine knuckle boom crane according to the present invention comprises a stationary pedestal to be mounted to or formed integral with a vessel. In particular, the pedestal is preferably mounted on deck of the vessel, or it is also conceivable that the pedestal is formed integral with a portion of the hull and possibly the deck of the vessel, which may improve the overall stability of the crane.

The marine knuckle boom crane according to the present invention further comprises a crane housing that is mounted on the pedestal and adapted to slew, i.e. rotate, relative to the pedestal about a vertical rotation axis, e.g. via a rotating bearing, and a knuckle boom assembly, which is attached to the crane housing. As such, rotation of the main boom and jib in a horizontal plane is allowed, to have a large reach area of the crane.

In an embodiment of the marine knuckle boom crane the jib comprises a departing sheave, and the crane further comprises a hoist assembly, comprising a hoist winch and an associated hoisting cable, extending from the hoist winch via the departing sheave on the jib, e.g. at the tip of the jib, to an object/load suspension device, which preferably comprises a hook or the like. Upon actuation of the hoist winch the object suspension device can be raised and lowered. The hoist winch may be provided on the crane housing, or alternatively in the pedestal, or even at an alternative location such as in the hull of the vessel adjacent the pedestal.

It is also conceivable that instead of a hoist assembly, a gripper is mounted to the jib, e.g. to a tip end of the jib.

In a possible embodiment, the lower portion of crane housing is bolted via a slew bearing to the pedestal. Preferably, the hoist winches of such a knuckle boom crane are fitted outside the crane housing since they require a large storage capacity for ultra deep lifts.

It is advantageous for the interplay of forces when the luffing cable and the tensioning member are not provided in parallel. Thus, the provision of an elongated crane housing allows a configuration in which the luffing cable extends between the outer end of the main boom and an upper end of the crane housing, to extend in a direction relatively close to the horizontal direction. The tensioning member may still be allowed to extend between the curved extension guide and a lower portion of the crane housing close to the pedestal, to extend in a direction relatively closer to the vertical direction. As such, the luffing cable and the tensioning member extend at an angle with respect to each other, which is advantageous for the interplay of forces. Preferably, the angle between the luffing cable and the tensioning member is at least 40°.

Alternatively, the pedestal can be embodied as a fixed mast, wherein the crane housing is embodied as a rotating slew platform supporting the main boom, and a mast head at the top of the mast. The hoisting cable is allowed to run from the mast head or the rotating slew platform to the tip of the jib. Also the luffing cable is allowed to run from the mast head to the main boom, to control the position of the main boom. Possibly also the tensioning member is allowed to run from the mast head to the curved extension guide to control the position of the jib. This allows the different hoists to be positioned at the preferred radius. The mast construction gives an inherent safety feature; the load moment is carried by the mast and not by the slew bearings.

Major components of the crane may be installed inside the pedestal mast, well protected from the harsh marine environment. The rotating parts of the crane are provided with totally enclosed slew bearings and therefore maintenance is limited.

In a possible embodiment, a yang is provided between the main boom and the jib to position and/or fixate the position of the jib with respect to the main boom. Possibly, the yang is connected to a central area of the main boom and to a central area of the jib. The tensioning member, together with the curved extension guide, is able to lower and raise the jib with respect to the main boom.

When the main boom is in an upright, vertical position, the jib can be raised to the vertical position in which the tip extends upwardly and lowered 180° to a vertical position in which the tip extends downwardly, and in which the jib is folded back, essentially parallel along the main boom. In a situation in which the main boom is positioned horizontally, the tensioning member and curved extension guide are able to pull the jib upwards to a vertical position in which the tip extends upwards, and to lower the jib until the tip of the jib extends downwards. However, in this situation the tensioning member is not able to pivot the jib further to the folded position in which the jib is folded back along the main boom. In this situation the provision of a yang is advantageous, as such a yang is able to pull the jib towards the main boom to a folded position. Thus, the yang is used to allow even more relative positions of the jib and main boom.

Another advantage of a yang is that it may contribute to the fixation of the jib relative to the main boom. In a general configuration, the jib is prevented from lowering by the tensioning member. The jib is prevented to move upwards by gravity, not only exerted on the jib itself but also on a load which is possibly suspended from the hoisting cable. However, due to sea state induced vessel motions, gravity, in particular when only exerted on the jib alone, may be insufficient to prevent small upward movements of the jib. The provision of a yang will fixate the jib relative to the yang.

The invention is further elucidated in the attached drawings, in which.

Figure 6B:
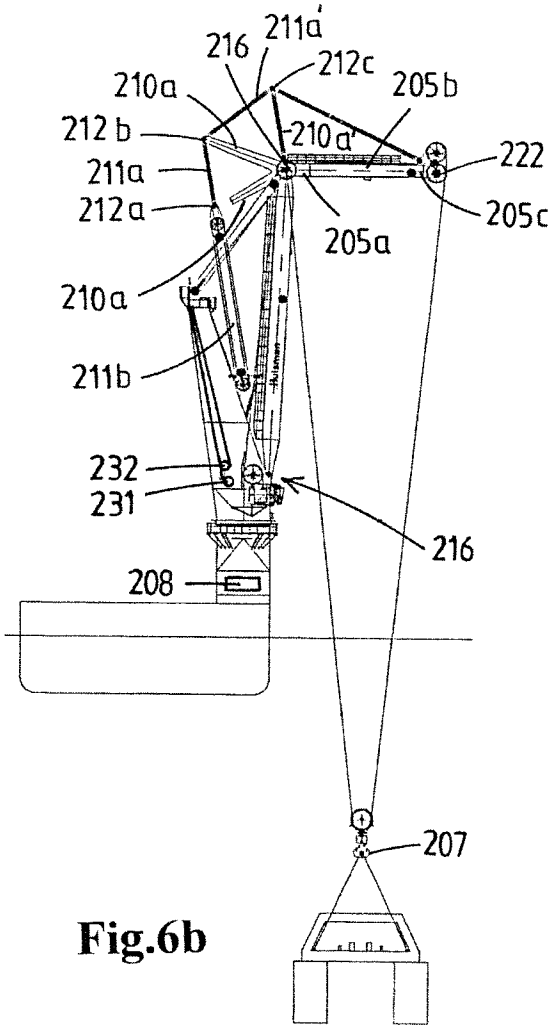
Figure 6A:
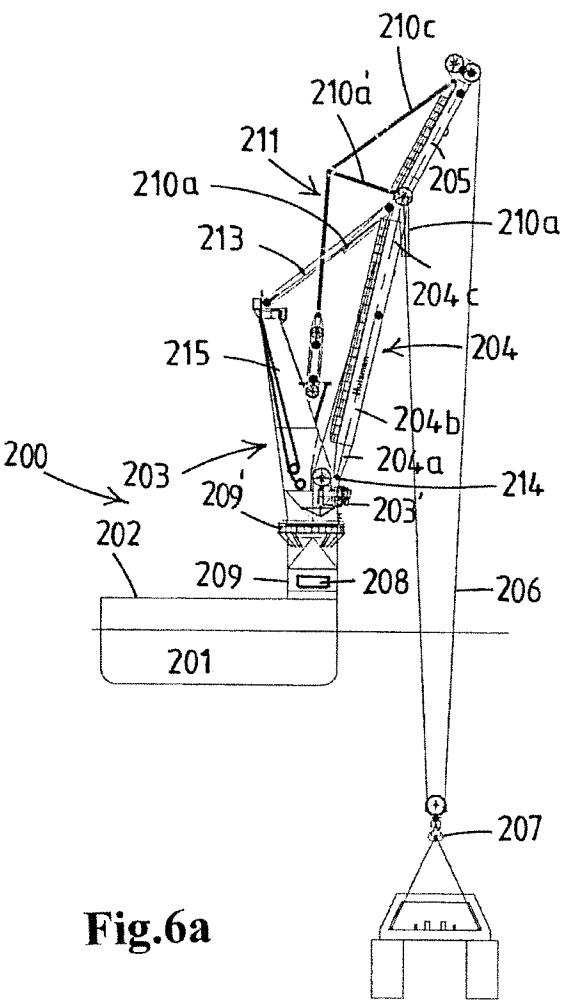
Figure 6C:
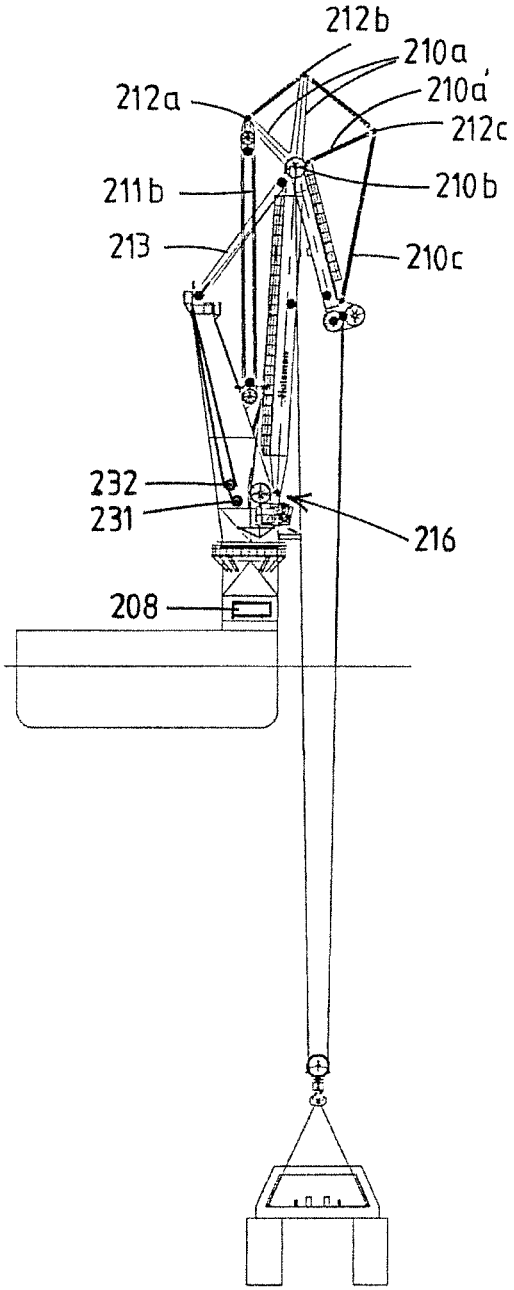

FIGS. 6*a*-6*c* show a schematical side view of a third embodiment of a marine knuckle boom crane according to the present invention in various positions.

Figure 1:
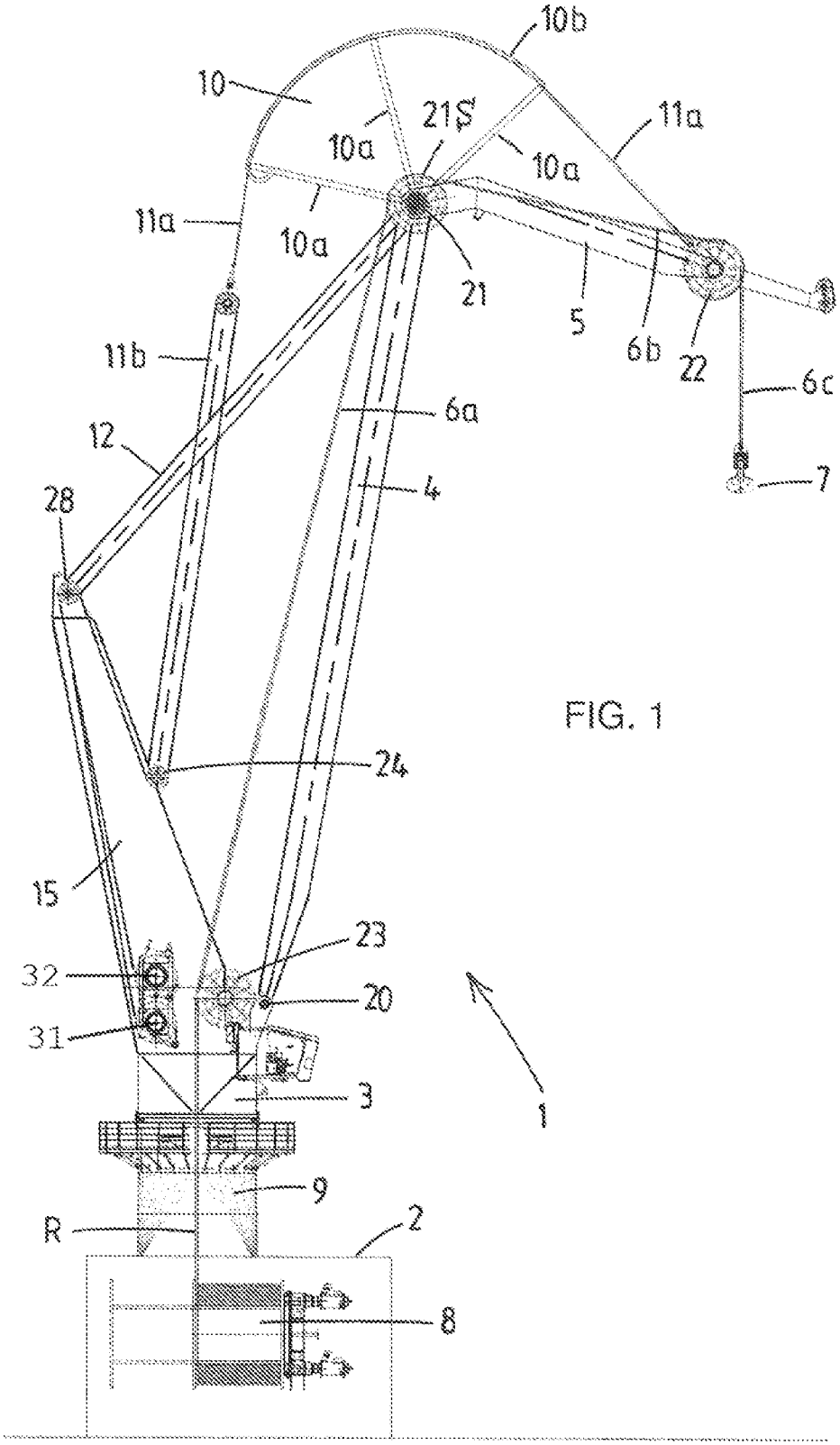
FIG. 1 shows a schematical side view of a first embodiment of a marine knuckle boom crane according to the present invention.

In FIG. 1 a marine knuckle boom crane 1 according to the invention is schematically shown. The marine knuckle boom crane 1 comprises a stationary pedestal 9, which in the shown embodiment is mounted to the deck 2 of a vessel (not shown). A crane housing 3, 15 is provided rotational relative to the pedestal 9 about a vertical rotation axis R. The crane housing of this embodiment comprises a base portion 3, having a cross section essentially similar to that of the pedestal 9, and an elongated portion 15 extending essentially upwards from the base portion, defining an upper portion of the crane housing.

Attached to a lower portion of the crane housing 3 is the inner end of a main boom 4, which is connected pivotably about a first horizontal pivot axis 20 to the crane housing 3, 15. A jib 5 is connected pivotably about a second horizontal pivot axis 21 to the outer end of the main boom 4.

A hoist assembly is provided, comprising a hoist winch 8 which is in the shown embodiment provided below deck 2, below the pedestal 9, in the hull of the vessel (not shown). The hoist winch 8 of the shown embodiment can be translated to a position shown in dotted lines. Possibly, the hoist winch is skiddable via a mechanism described in our co-pending application having priority number NL1039735. From the hoist winch 8 a hoisting cable 6*a*, 6*b*, 6*c* extends, which extends via sheaves 23, 21*s*, 22 over the jib to a load suspension device 7. The pivot axis of sheave 21*s* coincides with pivot axis 21. Sheave 22 on the jib is defined as the departing sheave 22.

In order to position the main boom 4, a luffing device 12 is provided, extending between the outer end of the main boom 4, here in particular in the vicinity of the second pivot axis 21, and the crane housing, here an upper point 28 of the upper portion 15 of the crane housing. The luffing device preferably comprises a luffing winch 31 and a luffing cable.

In order to position the jib 5 with respect to the main boom 4, a tensioning member 11*a*, 11*b* is provided, extending between the crane housing and a curved extension guide 10. In the shown embodiment the tensioning member is connected to the upper portion 15, in particular to a sheave 24 provided in the central area of the upper portion 15. It is also conceivable that the tensioning member 11*a*, 11*b* is attached to the lower end of the upper portion, or directly to the lower portion of the crane house 3.

The shown tensioning member 11*a*, 11*b* comprises a combination of cables and sheaves 11*b*, which can be actuated via a tensioning winch 32 to vary in length. The tensioning member further comprises a cable 11*a*, a portion of which is guided along the outer contour of the curved extension guide 10. The curved extension guide 10 is connected to the jib 5, here near the inner end of the jib 5, and is pivotable together with the jib 5 about the second pivot axis 21. The extension guide 10 of the shown embodiment comprises three spokes 10*a*, interconnected by a guide 10*b* defining a curvature approximating a portion of a circle about the second pivot axis 21. Cable 11*a* is guided along this guide 10*b*.

In FIGS. 2-5 a second embodiment of a knuckle boom crane 100 according to the invention is shown. Similar to the embodiment of FIG. 1, the marine knuckle boom crane comprises a stationary pedestal 109, mounted to the deck 102 of a vessel, not shown. A crane housing 103 is provided rotational relative to the pedestal 109 about a vertical rotation axis 108. To this end, a horizontal rotational bearing is provided between the pedestal 109 and the crane housing 103. In the shown embodiment, a platform 109' is connected to the pedestal 109. The crane housing is provided with an operator's housing 103'.

The crane housing 103 comprises an elongated portion 115. In the shown embodiment the elongated portion is shaped as a closed vertical column tapering towards the top. The central axis of the elongated portion extends at an angle of about 20° with respect to the vertical, to give room to the main boom 104.

The knuckle boom assembly comprises a main boom 104 and a jib 105. The main boom 104 comprises an inner end 104*a*, a central area 104*b* and an outer end 104*c*. The main boom 104 is connected at its inner end 104*a* pivotably to the lower portion of the crane housing 103, rotatable about a first horizontal pivot axis 114.

A jib 105 is provided, comprising an inner end 105*a*, a central area 105*b* and a tip 105*c* opposite the inner end 105*a* of the jib. The inner end 105*a* of the jib is connected pivotably about a second pivot horizontal axis 116 to the outer end 104*c* of the main boom.

The knuckle boom crane of this embodiment further comprises a hoist assembly to hoist and lower loads. The hoist assembly comprises a hoisting cable 106, only part of which is visible in FIGS. 2-5. The hoisting cable 106 extends from a hoist winch (not visible but similar to hoist winch 8 show in FIG. 1), which is preferably positioned in or below the pedestal of the crane, via one or more sheaves, in particular a sheave 122 at the tip 105*c* of the jib to a load suspension device 107.

The main boom 104 and the jib 105 may be of any configuration, e.g. one of them or both may have a truss-shaped framework, but alternatively it is also conceivable that one of them or both are formed as a closed box.

In order to position the jib 105 with respect to the main boom 104, according to the invention a tensioning member 111*a*, 111*b* and a curved extension guide 110 are provided. The tensioning member 111*a*, 111*b* extends between the upper portion 115 of the crane housing 103 and the curved extension guide 110. In the shown embodiment, the tensioning member 111*a*, 111*b* is connected to a central area 115*b* of the upper portion 115. It is also conceivable that the tensioning member 111*a*, 111*b* is connected to a lower end of the upper portion 115, or to the foot of the crane housing 103. It is possible, but less preferred in view of the interplay of forces, that the tensioning member 111*a*, 111*b* is connected to the upper end of the upper portion 115.

In the shown embodiment, the tensioning member 111*a*, 111*b* comprises a first portion 111*a* being guided by the curved extension guide 110 and a second portion 111*b* of the which the length may be varied by the tensioning winch, and as such position the jib.

The curved extension guide 110 is in this embodiment, contrary to the embodiment shown in FIG. 1, of a more oval, not rounded structure. It comprises a bent portion 110*d*, mounted to various spokes 110*a*, which extend from a hub 110*b*. The spokes 110*a* may vary in length, as in the embodiment of FIG. 2. The mutual dimensions of the spokes can vary from embodiment to embodiment, and be adjusted to the desired curvature of the curved guide member which is dependent from the overall dimensions of the marine knuckle boom crane.

In this embodiment, the curved extension guide 110 is mounted to the jib 105 via a connecting beam 110*c*, extending from an end of the bent portion 110*d* to the tip of the jib 105*c*. The curved extension guide 110 is pivotable together with the jib 105 about the second pivot axis 116, to which also hub 110*b* is mounted.

In the shown embodiment, first portion 111*a* of the tensioning member is being guided by the curved extension guide 110 and extends from the second portion 111*b* to the top of the curved extension guide 110 to a connection point 110*e*.

Figure 2:
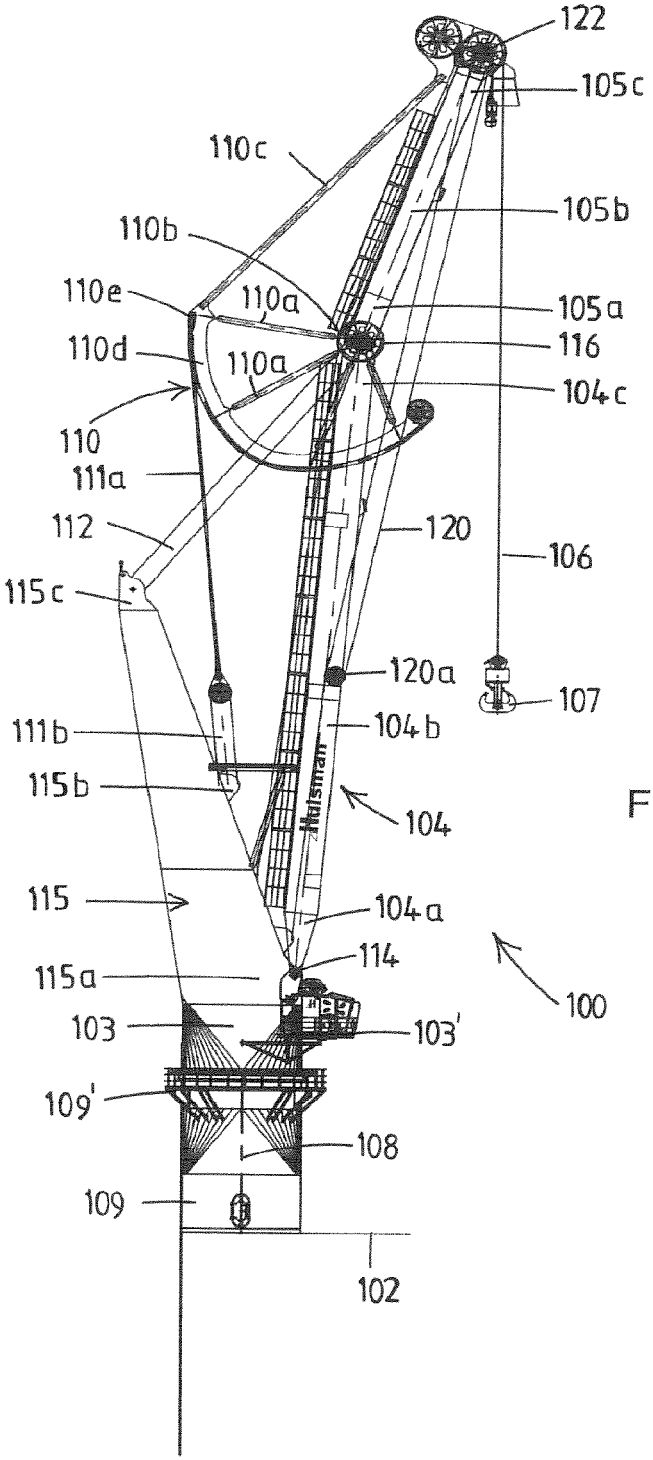
FIG. 2 shows a schematical side view of a second embodiment of a marine knuckle boom crane according to the present invention in a first position.
Figure 3:
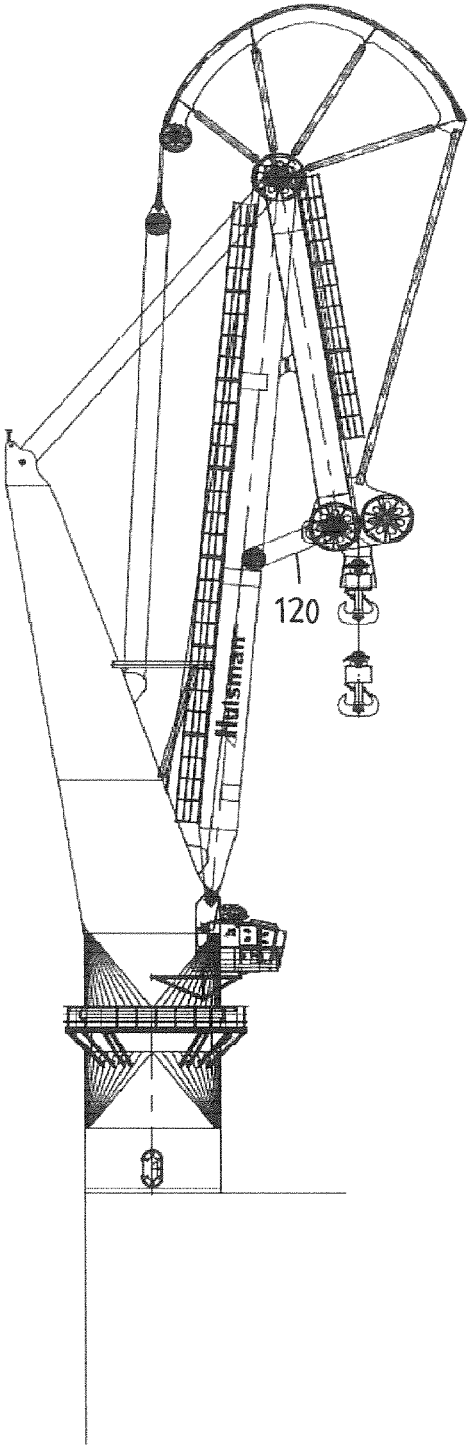
FIG. 3 shows a schematical side view of the second embodiment of a marine knuckle boom crane according to the present invention in a second position.
Figure 4:
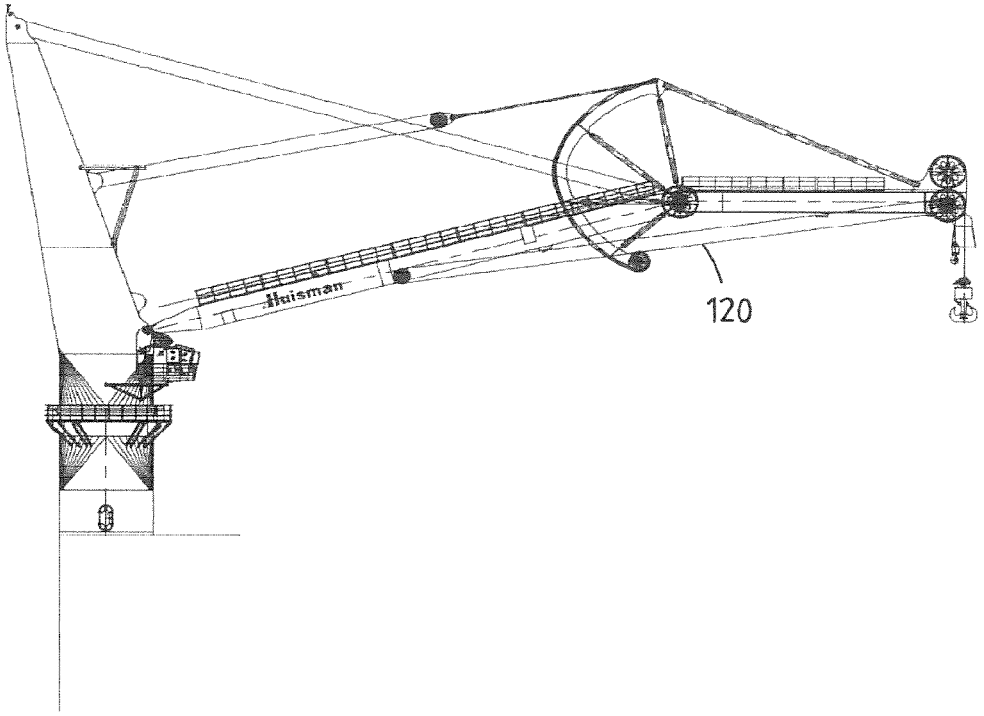
FIG. 4 shows a schematical side view of the second embodiment of a marine knuckle boom crane according to the present invention in a third position.
Figure 5:
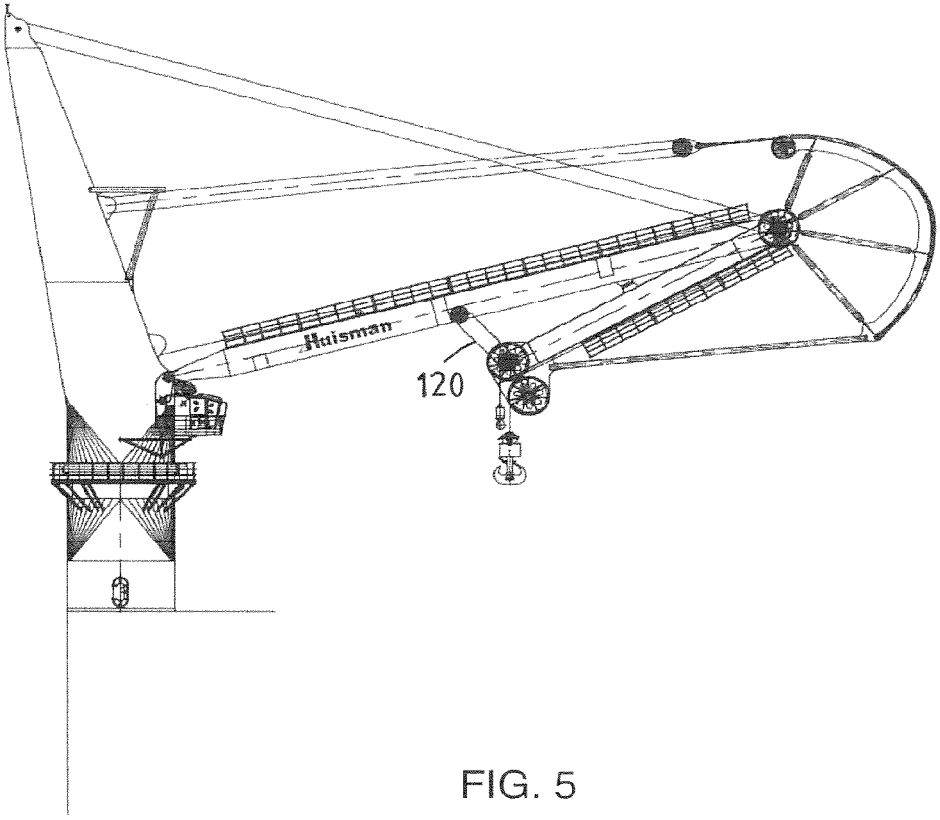
FIG. 5 shows a schematical side view of the second embodiment of a marine knuckle boom crane according to the present invention in a fourth position.

The combination of tensioning member 111*a*, 111*b* and a curved extension guide 110 enables an accurate control of the position of the jib 105 at a range of different positions with respect to the main boom 104: from an extended position in which the tip 105*c* extends mainly forward from the main boom, as visible in FIGS. 2 and 4, to a folded position in which the jib is folded back, essentially parallel along the main boom, as is visible in FIGS. 3 and 5.

In order to position the main boom, a luffing cable 112 is provided, extending between the main boom and the crane housing. The luffing cable is preferably connected to the outer end of the main boom, in particular to a sheave connected to the outer end of the main boom, or advantageously to a sheave rotatable about the second pivot axis 116 as in the shown embodiment.

The luffing cable 112 extends to the crane housing 103, which may theoretically be a lower portion of the crane housing 103 close to the pedestal 109. In order to allow the main boom to extend in a vertical direction, it is preferred for the luffing cable to be connected to a portion of the crane housing remote from the location where the main boom is connected to the crane housing. In the shown embodiment, the main boom 104 is rotatably connected to the crane housing about pivot axis 114. The luffing cable 112 is connected to the upper end of the elongated portion 115, being as remote as possible from the main boom connection point. As such, a variety of positions of the main boom is possible: from an almost vertical position as shown in FIGS. 2 and 3, to an almost horizontal position as shown in FIGS. 4 and 5.

Advantageaously, a yang 120 is provided between the main boom and the jib. In the shown embodiment, the yang is embodied as a cable which can be actuated by a winch, which is not shown. Alternatively, the yang can be embodied as a cylinder, but this may cause restrictions in use in terms of stroke.

The yang 120 is connected to the main boom, here to the central area 104*b* of the main boom, and to the jib. It is conceivable that the yang is connected to the central area 105*b* of the jib, or to the tip of the jib 105*c* as in the shown embodiment.

In FIGS. 2 and 4, the yang is at its maximum length, allowing the knuckle boom to be in its extended position in which the tip 105*c* extends mainly forward from the main boom. In FIGS. 3 and 5, the yang 120 is shown at its minimum length, being fully retracted. This allows the knuckle boom to be in its folded position in which the jib 105 is folded back, essentially parallel along the main boom 104.

The function of the yang in the positions shown in FIGS. 2-4 is to fixate the position of the jib 105, in particular, to prevent an upward movement of the jib. In particular in the position shown in FIG. 4, due to sea-state induced vessel motions it is possible for the main boom and the jib to be lifted up slightly. This is prevented by gravity, not only exerted on the main boom and the jib but also to a load which may be suspended from the crane assembly. The yang 120 further contributes to the prevention of undesired lifting up movements.

In FIG. 5, the yang 120 is shown at its minimum length, allowing the knuckle boom to be in its folded position in which the jib 105 is folded back, essentially parallel along the main boom 104. The function of the yang in this position is to position the jib 105 in the folded position, as the combination of tensioning member 111*a*, 111*b* and curved guide assembly 110 is capable of positioning the jib with respect to the main boom into the positions shown in FIGS. 2-4, but not to the position shown in FIG. 5. To arrive at this position, the yang 120 has to be actuated to bring and maintain the jib 105 to this retracted position.

In FIGS. 6*a*-6*c* a third embodiment of a knuckle boom crane 200 according to the invention is shown. Similar to the embodiment of FIG. 1, the marine knuckle boom crane comprises a stationary pedestal 209, mounted to the deck 202 of a vessel 201. A crane housing 203 is provided rotational relative to the pedestal 209 about a vertical rotation axis. To this end, a horizontal rotational bearing is provided between the pedestal 209 and the crane housing 203. In the shown embodiment, a platform 209' is connected to the pedestal 209. The crane housing is provided with an operator's housing 203'.

The crane housing 203 comprises an elongated portion 215. In the shown embodiment the elongated portion is shaped as a closed vertical column tapering towards the top. The central axis of the vertical elongated portion extends at an angle of about 20° with respect to the vertical, to give room to the main boom 204.

The knuckle boom assembly comprises a main boom 204 and a jib 205. The main boom 204 comprises an inner end 204*a*, a central area 204*b* and an outer end 204*c*. The main boom 204 is connected at its inner end 204*a* pivotably to the lower portion of the crane housing 203, rotatable about a first horizontal pivot axis 214.

A jib 205 is provided, comprising an inner end 205*a*, a central area 205*b* and a tip 205*c* opposite the inner end 205*a* of the jib. The inner end 205*a* of the jib is connected pivotably about a second pivot horizontal axis 216 to the outer end 204*c* of the main boom.

The knuckle boom crane of this embodiment further comprises a hoist assembly 216 to hoist and lower loads. The hoist assembly comprises a hoisting cable 206, only part of which is visible in FIGS. 6*a*-6*e*. The hoisting cable 206 extends from a hoist winch 208, which is preferably positioned in or below the pedestal of the crane, via one or more sheaves, in particular a sheaves 222 at the tip 205*c* of the jib to a load suspension device 207.

The main boom 204 and the jib 205 may be of any configuration, e.g. one of them or both may have a truss-shaped framework, but alternatively it is also conceivable that one of them or both are formed as a closed box.

In order to position the jib 205 with respect to the main boom 204, according to the invention a tensioning member 211 and a curved extension guide 210 are provided.

The tensioning member 211 extends between the upper portion 215 of the crane housing 203 and the curved extension guide 210. In the shown embodiment, the tensioning member 211 is connected to a central area 215*b* of the elongated portion 215.

The curved extension guide 210 is in this embodiment approximated by a polygon, formed by the distal outer ends of spokes 210*a* and 210*a*' which are not interconnected at their distal outer ends. Spokes 210*a* extend from a common hub 210*b*. The spokes 210*a*, 210*a*' vary in length.

According to the invention, the tensioning member extends between the crane housing and the curved extension guide. In the shown embodiment, the tensioning member 211 comprises a first portion 211*a*, 211*a*' being guided by the curved extension guide 210 and a second portion 211*b* which the length may be varied by the tensioning winch 232, and as such position the jib. In the shown embodiment, the tensioning member 211 comprises multiple articulated interconnected elongated rods 211*a* and 211*a*', being pivotably connected to the second portion 211*b* via pivot point 212*a* and being pivotably interconnected via pivot points 212*b* and 212*c*. In particular, the second portion 211*b* of the tensioning member comprises a cable and sheaves, wherein the length of the cable may be varied by a tensioning winch 232. The upper sheave of the second portion of the tensioning member is in the shown embodiment directly connected to the lower end of the interconnected elongated rods of the first portion of the tensioning member 211. In this embodiment, the pivot points 212*a*, 212*b* between the elongated rods 211*a*, 211*a*', are adapted to connect to the distal ends of the 'spokes' 210*a* of the curved extension guide. Hence, as visible in FIG. 6*c*, the upper sheave of the shown embodiment of the tensioning member can be connected to the distal end of spoke 210*a*.

In this embodiment, the curved extension guide 210 is mounted to the jib 205 via a connecting beam 210*c*, extending from spoke 210*a*' and pivot axis 212*c* to the tip of the jib 205*c*. The curved extension guide 210 is pivotable together with the jib 205 about the second pivot axis 216, to which also hub 210*b* is mounted. Alternatively, it is also conceivable that beam 210*c* is part of the tensioning member, comprising consecutively first portion 211*b*, tow which elongated rod 211*a* is connected, to which rod 211*a*' is connected, to which beam 210*c* is connected.

The combination of tensioning member 211*a*, 211*a*', 211*b* and a curved extension guide 210 with spokes 210*a*, enables an accurate control of the position of the jib 205 at a range of different positions with respect to the main boom 204: from an extended position in which the tip 205*c* extends mainly forward from the main boom, as visible in FIG. 6*a*, to a folded position in which the jib is folded back, essentially parallel along the main boom, as is visible in FIG. 6*c*.

In order to position the main boom, a luffing cable 213 is provided, extending between the outer end 204*c* of the main boom 204 and the top of the crane housing 215. The luffing cable is connected to the, in particular to a sheave connected to the outer end of the main boom, or advantageously to a sheave rotatable about the second pivot axis 216 as in the shown embodiment. A luffing winch 231 is provided to allow to vary the length of the luffing cable 213 and thus to position the main boom 204.

In the shown embodiment, the main boom 204 is rotatably connected to the crane housing about pivot axis 214. The luffing cable 213 is connected to the upper end of the upper portion 115, being as remote as possible from the main boom connection point. As such, a variety of positions of the main boom is possible.

The invention claimed is:

1. A marine knuckle boom crane comprising:

a pedestal;

a crane housing being rotational relative to the pedestal about a vertical rotation axis;

a main boom comprising an inner end and an outer end, the inner end of which is connected pivotably about a first horizontal pivot axis to the crane housing; and a luffing assembly configured to position the main boom;

a jib comprising an inner end and a tip opposite the inner end of the jib, the inner end of the jib being connected pivotably about a second horizontal pivot axis to the outer end of the main boom, wherein the jib is pivotable at least between an extended position in which the tip extends mainly forward from the main boom, and a folded position in which the jib is folded back;

a spoke structure mounted to the jib and pivotable together with the jib about the second pivot axis, wherein the spoke structure comprises a first spoke, a second spoke, and a third spoke, each spoke having a distal end;

a connecting beam between the distal end of the third spoke and the tip of the jib;

a jib pivoting winch configured to pivot the jib;

a tensioning member extending from the jib pivoting winch to the distal end of the third spoke, wherein the tensioning member comprises:

a first portion connected to the distal end of the third spoke and comprising articulated elongated rods, mutually interconnected via a second pivot point; and a second portion of variable length, extending between the first portion and the jib pivoting winch, and connected to one of the at least two articulated elongated rods via a first pivot point; wherein the first and second pivot points of the tensioning member are adapted to coincide with the distal ends of the first and second spokes, respectively, wherein when the jib is in the folded position, the first and second pivot points of the first portion of the tensioning member coincide with the distal ends of the first and second spokes, respectively, when the jib is in the extended position, the first pivot point is spaced apart from the distal end of the first spoke by a distance, with the distal end of the first spoke being a free end, and the second pivot point is spaced apart from the distal end of the second spoke by a distance, with the distal end of the second spoke being a free end, and when the jib is in an intermediate position between the folded position and the extended position, the first pivot point is spaced apart from the distal end of the first spoke by a distance, with the distal end of the first spoke being a free end, and the second pivot point coincides with the distal end of the second spoke.

2. Marine knuckle boom crane according to claim 1, wherein the second portion of the tensioning member comprises a cable.

3. Marine knuckle boom crane according to claim 2, wherein the cable of the second portion of the tensioning member extends between the jib pivoting winch and a distal sheave, which distal sheave is connected directly to said one of the at least two articulated interconnected elongated rods.

4. Marine knuckle boom crane according to claim 1, further comprising a hoist assembly, comprising a hoist winch and a hoisting cable, extending from the hoist winch via sheaves over the tip of the jib to a load suspension device.

5. Marine knuckle boom crane according to claim 1, wherein the stationary pedestal is mounted to, or formed integral with a vessel.

6. Marine knuckle boom crane according to claim 1, wherein the crane housing comprises an elongated portion, shaped as a closed vertical column tapering towards the top, and wherein the second portion of the tensioning member extends from a central portion of the crane housing.

7. Marine knuckle boom crane according to claim 1, wherein the spokes extend from a common hub.

8. Marine knuckle boom crane according to claim 1, wherein the spokes vary in length.

9. Marine knuckle boom crane according to claim 1, wherein a sheave is connected to the outer end of the main boom, to which the luffing cable is connected.

10. Marine knuckle boom crane according to claim 9, wherein the sheave is rotatable about the second pivot axis.

11. Marine knuckle boom crane according to claim 1, wherein the luffing assembly comprises a luffing winch and a luffing cable extending between the main boom and the crane housing, configured to position the main boom.

12. Marine knuckle boom crane according to claim 1, wherein the jib pivoting winch is arranged on the crane housing.

* * * * *